US010580345B2

(12) United States Patent
Sakamaki et al.

(10) Patent No.: US 10,580,345 B2
(45) **Date of Patent: *Mar. 3, 2020**

(54) DISPLAY DRIVER AND DISPLAY PANEL MODULE

(71) Applicant: Synaptics Japan GK, Nakano, Tokyo (JP)

(72) Inventors: Goro Sakamaki, Tokyo (JP); Kei Miyazawa, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/425,605

(22) Filed: May 29, 2019

(65) Prior Publication Data

US 2019/0279557 A1 Sep. 12, 2019

Related U.S. Application Data

(63) Continuation of application No. 15/419,586, filed on Jan. 30, 2017, now Pat. No. 10,332,442.

(30) Foreign Application Priority Data

Feb. 10, 2016 (JP) ..... 2016-023425

(51) Int. Cl.
*G09G 3/20* (2006.01)
*G09G 3/36* (2006.01)

(52) U.S. Cl.
CPC ..... *G09G 3/2096* (2013.01); *G09G 3/3648* (2013.01); *G09G 2300/0426* (2013.01);
(Continued)

(58) Field of Classification Search
CPC ..... G09G 3/2096; G09G 3/3648; G09G 2300/0426; G09G 2310/0291; G09G 2310/08
See application file for complete search history.

(56) References Cited

U.S. PATENT DOCUMENTS

2006/0244741 A1* 11/2006 Kimura ..... G02F 1/13452 345/204
2008/0136847 A1 6/2008 Yajima et al.
(Continued)

FOREIGN PATENT DOCUMENTS

JP 2002278492 9/2002
JP 2005182010 7/2005
(Continued)

*Primary Examiner* — Deeprose Subedi
(74) *Attorney, Agent, or Firm* — Patterson + Sheridan, LLP

(57) ABSTRACT

Provided is a display driver which can be used in common in any of COF mounting and COG mounting. In the display driver, a position (or write/output position) of display data output by an output circuit can be changed along a direction of an array of external output terminals S1 to S540 according to mode data, whereby an array of external output terminals to use for output can be selected from more than one kind of arrays different in layout pitch. Therefore, the display driver can be used in display panels with signals lines having different pitches serving to receive drive signals from the display driver and in addition, used in common in any of COF mounting and COG mounting which are different from each other in the pitch of mounting wiring lines.

20 Claims, 16 Drawing Sheets

(52) U.S. Cl.
CPC . *G09G 2310/0291* (2013.01); *G09G 2310/08* (2013.01); *G09G 2370/08* (2013.01)

(56) References Cited

U.S. PATENT DOCUMENTS

| | | | | |
|---|---|---|---|---|
| 2008/0218500 | A1* | 9/2008 | Akai | G09G 3/3688 345/205 |
| 2009/0295777 | A1* | 12/2009 | Wang | G09G 3/3614 345/212 |
| 2017/0193872 | A1* | 7/2017 | Lee | G09G 3/006 |

FOREIGN PATENT DOCUMENTS

| | | |
|---|---|---|
| JP | 2005257899 | 9/2005 |
| JP | 2006013421 A | 1/2006 |
| JP | 2007183542 | 7/2007 |
| JP | 2008065295 | 3/2008 |
| WO | WO-2011129400 | 10/2011 |

* cited by examiner

| | | | |
|---|---|---|---|
| D0 | D0_P1 r | D0_P1 g | D0_P1 b |
| D1 | D1_P2 r | D1_P2 g | D1_P2 b |
| D2 | D2_P3 r | D2_P3 g | D2_P3 b |
| D3 | D3_P4 r | D3_P4 g | D3_P4 b |
| D4 | D4_P5 r | D4_P5 g | D4_P5 b |
| D5 | D5_P6 r | D5_P6 g | D5_P6 b |

Fig.10

| | COG | COF |
|---|---|---|
| DISPLAY PANEL MODULE EDGE | Wide | Narrow |
| DISPLAY DRIVER BUMP PITCH | > 10 μm | > 20 μm |
| DISPLAY PANEL MODULE COST | Low | high |

Fig.11

| | | Pad assignment for COG (1) | Pad assignment for COF (1) |
|---|---|---|---|
| FHD | 540 ch | S1 to S540 | -- |
| HD | 360 ch | S1 to S180<br>S360 to S540 | -- |
| WVGA | 240 ch | S1 to S120,<br>S421 to S540 | S(2n+1) n=0 to 119,<br>S(539 – 2n) n=119 to 0 |
| 540 x 540 | 270 ch | S1 to S135,<br>S406 to S540 | S(2n+1) n=0 to 269 |
| 420 x 420 | 210 ch | S1 to S105,<br>S436 to S540 | S(2n+1) n=0 to 104,<br>S(539 – 2n) n=104 to 0 |
| 360 x 360 | 180 ch | S1 to S90,<br>S451 to S540 | S(2n+1) n=0 to 89,<br>S(539 – 2n) n=89 to 0 |

Fig.14

| Pixel | P1 | P2 | P3 | P4 | P5 | P6 | P7 | P8 | P9 | P10 | P11 | P12 | P13 | P14 | P15 | P16 | P17 | P18 | P19 | P20 | P21 | P22 | P23 | P24 |
|---|---|---|---|---|---|---|---|---|---|---|---|---|---|---|---|---|---|---|---|---|---|---|---|---|
| Output pad | S1 | | S2 | | S3 | | S4 | | S5 | | S6 | | S7 | | S8 | | S9 | | S10 | | S11 | | S12 | |
| Address | A0 | A1 | A2 | A3 | A4 | A5 | A6 | A7 | A8 | A9 | A10 | A11 | A12 | A13 | A14 | A15 | A16 | A17 | A18 | A19 | A20 | A21 | A22 | A23 |
| Data | D0 | D1 | D2 | D3 | D4 | D5 | D6 | D7 | D8 | D9 | D10 | D11 | D12 | D13 | D14 | D15 | D16 | D17 | D18 | D19 | D20 | D21 | D22 | D23 |

• • •

Fig.17

| Pixel | P1 | P2 | | P3 | P4 | | P5 | P6 | | P7 | P8 | | P9 | P10 | | P11 | P12 | |
|---|---|---|---|---|---|---|---|---|---|---|---|---|---|---|---|---|---|---|
| Output pad | S1 | | | S3 | | | S5 | | | S7 | | | S9 | | | S11 | | ... |
| Address | A0 | A1 | | A4 | A5 | | A8 | A9 | | A12 | A13 | | A16 | A17 | | A20 | A21 | |
| Data | D0 | D1 | | D2 | D3 | | D4 | D5 | | D6 | D7 | | D8 | D9 | | D10 | D11 | |

DISPLAY DRIVER AND DISPLAY PANEL MODULE

CROSS-REFERENCE TO RELATED APPLICATIONS

This application is a continuation of U.S. patent application Ser. No. 15/419,586 filed on Jan. 30, 2017, which claims priority from Japanese application JP 2016-023425 filed on Feb. 10, 2016, the content of which is hereby incorporated by reference into this application.

BACKGROUND

The present invention relates to a display driver and a display panel module, and a technique applicable to any of COG (Chip On Glass) mounting and COF (Chip On Film) mounting, e.g., a technique useful in application to a display driver operable to perform the display driving of a liquid crystal display panel.

In a display panel such as a liquid crystal display panel, display elements and signal lines for supplying drive signals to the display elements are formed on a glass substrate. The pitch of signal lines can be formed on a glass substrate with high precision and it can be made narrower than the pitch of wiring lines formed on a film such as a flexible printed wiring board (FPC).

Examples of the form of mounting a display driver used for display driving of a display panel, such as liquid crystal display panel, include COG mounting and COF mounting.

The COG mounting is a form of directly mounting a display driver of a bare chip (or a semiconductor chip shape) on a glass substrate on which display elements and transparent electrodes are formed. The mounting form is suitable for a high-speed action because of a smaller wiring load to a display driver. For instance, a semiconductor chip for display driving, which is suitable for COG mounting is shown by example in Japanese Unexamined Patent Publication No. JP-A-2008-145477. In the semiconductor chip, two rows of external output terminals for drive signals are arrayed along a lengthwise direction of the chip, and the two rows are displaced from each other in the lengthwise direction by about one half pitch. Further, the external output terminals of the rear row are led out through between the external output terminals of the front row and then, connected to signal lines of a display panel concerned. As described above, the pitch of an array of output terminals of a display driver to be mounted by COG mounting, i.e. the wiring line pitch of a wiring pattern on a glass substrate, to which the output terminals of the driver are connected, tends to get narrowed.

The COF mounting is a form of mounting a display driver of a semiconductor chip shape to a wiring pattern on a wiring circuit board in, e.g., a polyimide film. The wiring line pitch of a wiring pattern formed on the film inevitably becomes larger than the wiring line pitch of a wiring pattern formed on a glass substrate. A semiconductor chip of display driving use, which is mounted by COF mounting is shown by example in JP-A-2006-13421.

Hence, it is often the case that COG mounting is applied to a display driver of a display panel of high resolution such as FHD (Full High Definition), whereas COF mounting is applied to a display driver of a display panel of low resolution such as VGA (Video Graphics Array), of which the wiring pattern pitch of the display panel electrode is made relatively wide.

SUMMARY

One embodiment described herein is a display driver formed as a semiconductor integrated circuit of an elongated shape that includes a plurality of external output terminals regularly disposed along a lengthwise direction of the display driver, an output circuit operable to produce display drive signals to supply to a display panel using required external output terminals, an output mode register on which output mode data are set overwritably, and a control circuit operable to perform control for selecting an array of external output terminals to be used by the output circuit for outputting the display drive signals from more than one kind of arrays different in layout pitch according to the output mode data set on the output mode register.

Another embodiment described herein is a display driver for outputting display drive signals to display elements of a display panel, which is formed as a semiconductor integrated circuit of an elongated shape. The display driver includes a plurality of external output terminals regularly disposed along a lengthwise direction of the display driver, an output circuit operable to produce display drive signals to supply to a display panel from required external output terminals, a host interface circuit, a register circuit to input control data from the host interface circuit, and a control circuit operable to produce control signals based on the control data set on the register circuit. Moreover, the register circuit has an output mode register on which output mode data are set overwritably and the control circuit is configured to perform control for selecting an array of external output terminals to be used by the output circuit for outputting the display drive signals from more than one kind of arrays different in layout pitch according to output mode data set on the output mode register. Further, the more than one kind of arrays which can be selected by the control circuit includes an array of the external output terminals in which the condition of a pitch allocated for spacing between adjacent terminals of external output terminals used for outputting drive signals is changed.

Another embodiment described herein is a display panel module that includes a display panel having display elements arrayed in a matrix form and a display driver formed as a semiconductor integrated circuit of an elongated shape, and supplying display drive signals to the display panel. The display driver includes a plurality of external output terminals regularly disposed along a lengthwise direction of the display driver, an output circuit operable to produce display drive signals to supply to the display panel using required external output terminals, an output mode register on which output mode data are set overwritably, and a control circuit operable to perform control for selecting an array of external output terminals to be used by the output circuit for outputting the display drive signals frommore than one kind of arrays different in layout pitch according to the output mode data set on the output mode register. Further, the more than one kind of arrays which can be selected by the control circuit comprise an array of the external output terminals in which the condition of a pitch allocated for spacing between adjacent terminals of external output terminals used for outputting drive signals is changed.

BRIEF DESCRIPTION OF THE DRAWINGS

FIG. 6 is an explanatory diagram showing, by example, typical resolutions of display panels used for a smart phone, a smart watch, a free-form display and the like;

FIG. 10 is an explanatory diagram showing, by example, main differences between COG mounting and COF mounting;

FIG. 11 is an explanatory diagram showing, by example, the forms of utilizing external output terminals of the display driver on display panels of various resolutions, which are roughly classified according to whether COG mounting or COF mounting is applied;

FIG. 14 is an explanatory diagram showing the relation among each pixel, the external output terminal used for output thereof, pixel data, and the address of the register REG holding the pixel data in the connection form shown in FIG. 13;

FIG. 17 is an explanatory diagram showing the relation among each pixel, the external output terminal used for output thereof, pixel data, and the address of the register REG holding the pixel data in the connection form of FIG. 16;

DETAILED DESCRIPTION

Introduction

Figure 1:
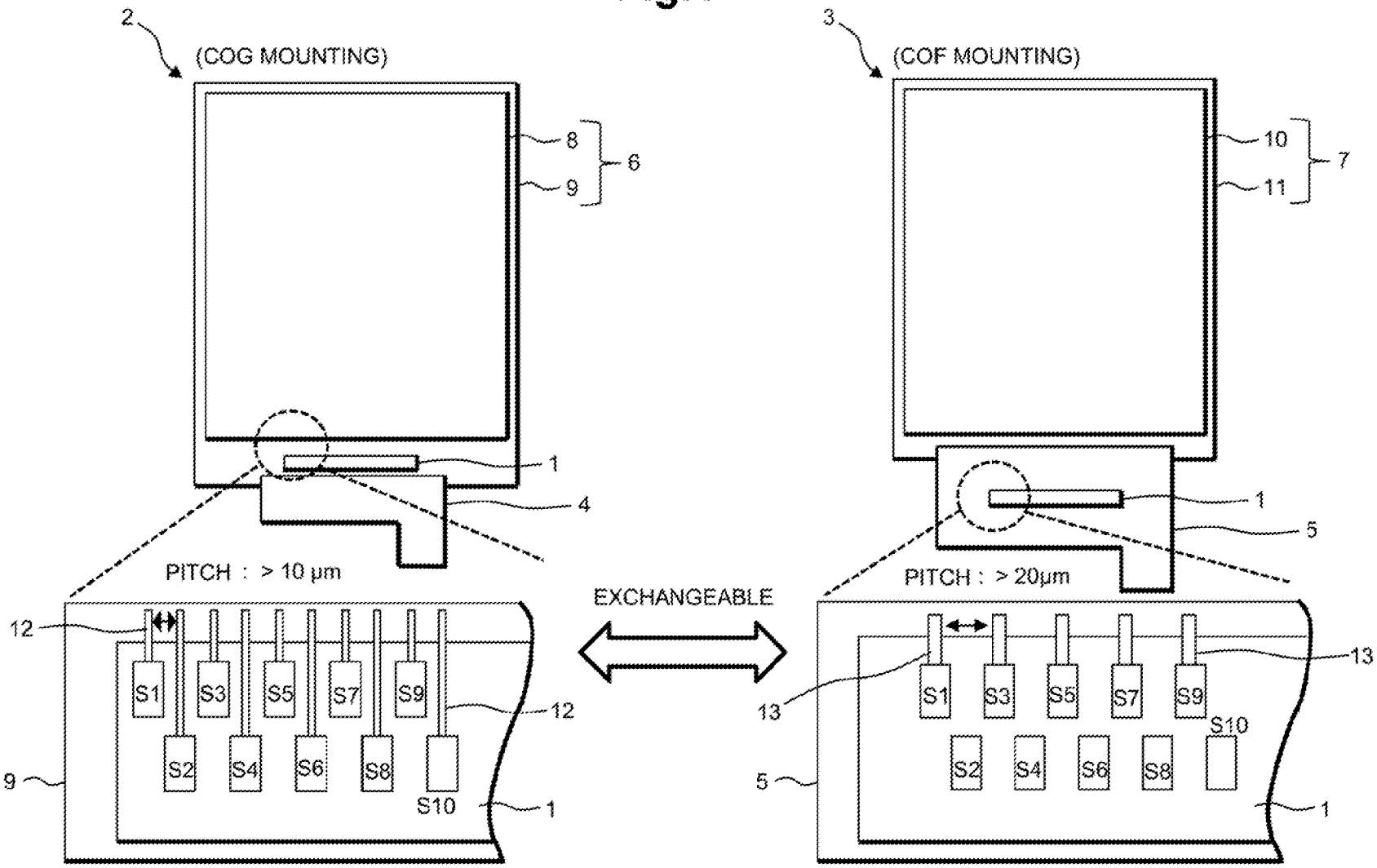
FIG. 1 is an explanatory diagram showing examples of application of a display driver which can be variably mounted in any of a COG mounting form and a COF mounting form.

A display driver optimized for a high-resolution display panel of which the electrode wiring pattern pitch is made relatively narrow is hard to adapt to a low-resolution display panel of which the electrode wiring pattern pitch is made relatively wide and vice versa. This is because the pitch of mounting bumps which are external output terminals of a display driver to which COF mounting is applied is, e.g., 20 μm or more, whereas the pitch of mounting bumps of a display driver to which COG mounting is applied is, e.g., 18 μm or less. Today's display panels including a liquid crystal display panel vary in size from FHD size of a compact and high definition display panel as utilized for a smart phone or the like to a size of a low-resolution display panel as utilized for a timepiece, a panel face of a dashboard panel provided as "INPANE" (i.e. instrument panel) of a motor vehicle, etc. So, using display drivers for exclusive use for such display panels respectively makes no contribution to the cutting of the cost of display panel modules.

Therefore, it is an object of the invention to provide a display driver which can be used commonly with display panels that have different pitches of signal lines serving to receive drive signals, and which can adapt to any of COF mounting and COG mounting. Further, the embodiments here may reduce the cost of display panel modules.

The above and other objects of the invention, and novel features thereof will become apparent from the description hereof and the accompanying diagrams.

Of the embodiments disclosed in the present application, the representative embodiments will be briefly outlined below. It is noted that the reference numerals and others in parentheses for reference to the diagrams are only examples for easier understanding.

[1] Array of External Output Terminals which can be Selected According to the Layout Pitch of an Electrode Pad Array of a Display Panel The display driver (1) formed as a semiconductor integrated circuit of an elongated shape includes: a plurality of external output terminals (S1-Sn) regularly disposed along a lengthwise direction of the display driver; an output circuit (46) operable to produce display drive signals to supply to a display panel (6, 7) from required external output terminals; an output mode register (60) on which output mode data (Mdata) are set overwritably; and a control circuit (43) operable to perform control for selecting an array of external output terminals to be used by the output circuit for outputting the display drive signals from more than one kind of arrays different in layout pitch according to the output mode data set on the output mode register. From another perspective, the control circuit is arranged to be able to change a position (or write/output position) of display data output by the output circuit along a direction of an external output terminal array, thereby making possible to select the array of the external output terminals used for output from more than one kind of arrays different in layout pitch.

According to this embodiment, one array can be selected from more than one kind of arrays different in layout pitch, as an array of external output terminals to use for outputting display drive signals when driving a display panel. So, an array of external output terminals to use for outputting display drive signals may be selected from more than one kind of arrays different in layout pitch so as to fit the pitch of pads to which the display driver is to be mounted. Therefore, the display driver can be used in display panels with signal lines having different pitches serving to receive drive signals and in addition, used in common in any of COF mounting and COG mounting which are different from each other in the pitch of mounting bumps.

[2] Line Latch Circuit and Drive Circuit

In the display driver as described in [1], the output circuit includes: a line latch circuit (44) having data registers (REG) arranged in parallel for holding pixel data; and a drive circuit (45) operable to produce, in units of pixel data, display drive signals from pixel data output by the line latch circuit and then provide the display drive signals to the external output terminals.

The control circuit performs write address control for sequentially writing pixel data into the line latch circuit according to the output mode data, and output control for outputting, in parallel, outputs of the data registers with pixel data written therein to the drive circuit.

According to this embodiment, the control for selecting an array of the external output terminals from more than one kind of arrays different in layout pitch can be easily realized by the address control and the output control by the control circuit.

[3] Sharing One External Output Terminal for Driving More than One Pixel

In the display driver as described in [2], the data registers each hold pixel data (Di_Pn r, Di_Pn g, Di_Pn b, Di_Pn+1 r, Pn+1 g, Pn+1 b) of more than one pixel as one unit. The drive circuit outputs drive signals corresponding to pixel data of more than one pixel output by the data registers in a time-sharing manner in the units of pixel data.

According to this embodiment, one external output terminal is shared to supply n pixels with display drive signals in a time sharing manner in case that one data register is holding pixel data of the n pixels, for example. This way enables the arrangement for leading out, in units of more than one line, signal lines of display elements of a high-resolution display panel to one piece of wiring pattern through a selector to connect to the corresponding external output terminal of the display driver. Thus, an array of external output terminals of the display driver can be arranged to have a pitch which enables the mounting of the display driver on a display panel with higher resolution.

[4] Sequence Control Logic

In the display driver as described in [2], the control circuit has program sequence control logics (61, 62) which decrypt output mode data set on the output mode register and produce control signals for the write address control and output control.

Unlike a hard wired logic, this embodiment enables the reduction in the circuit scale of the control circuit, and facilitates the setting and change of a control function.

[5] Array Forms Different in the Pitch Between Adjacent Terminals of External Output Terminals Used for Output In the display driver as described in [1], the more than one kind of arrays which can be selected by the control circuit include an array of the external output terminals in which the condition of a pitch allocated for spacing between adjacent terminals of external output terminals used for outputting drive signals is changed, and the external output terminals used for outputting drive signals are arrayed from both ends toward the center thereof along a lengthwise direction of the array.

In this embodiment, selectable arrays being different in the condition of a pitch allocated for spacing between adjacent terminals of the external output terminals implies that an array which can be selected even if the array pitch of a wiring pattern of a mounting target to which the display driver 1 is to be mounted is other than an integer multiple of the physical layout pitch of the external output terminals can be arranged. The selectable array variations are increased. Further, using a required number of external output terminals from both ends of an array of the external output terminals works to enlarge the inclination of a wiring pattern of a mounting target to which the display driver is to be mounted with respect to the array direction of the external output terminals, thereby preventing the wiring line pitch of the wiring pattern from being made extremely small.

[6] Array Forms Different in the Number of External Output Terminals Used for Outputting Drive Signals In the display driver as described in [5], the more than one kind of arrays which can be selected by the control circuit include an array of the external output terminals in which the number of external output terminals used for outputting drive signals is changed, and the external output terminals used for outputting drive signals are arrayed from both ends toward the center thereof along a lengthwise direction of the array.

This embodiment further increases the selectable array variations.

[7] Array of External Output Terminals which can be Selected According to the Layout Pitch of an Electrode Pad Array of a Display Panel A display driver (1) for outputting display drive signals to display elements of a display panel, which is formed as a semiconductor integrated circuit of an elongated shape includes: a plurality of external output terminals (S1-Sn) regularly disposed along a lengthwise direction of the display driver; an output circuit (46) operable to produce display drive signals to supply to a display panel from required external output terminals; a host interface circuit (40); and a register circuit (41) to input control data from the host interface circuit to; and a control circuit (43) operable to produce control signals based on the control data set on the register circuit. The register circuit has an output mode register (60) on which output mode data (Mdata) are set overwritably. The control circuit performs control for selecting an array of external output terminals to be used by the output circuit for outputting the display drive signals from more than one kind of arrays different in layout pitch according to output mode data set on the output mode register. The more than one kind of arrays which can be selected by the control circuit include an array of the external output terminals in which the condition of a pitch allocated for spacing between adjacent terminals of external output terminals used for outputting drive signals is changed.

According to this embodiment, one array can be selected from more than one kind of arrays different in layout pitch, as an array of external output terminals to use for outputting display drive signals when driving a display panel. So, an array of external output terminals to use for outputting display drive signals may be selected from more than one kind of arrays different in layout pitch so as to fit the pitch of pads to which the display driver is to be mounted. Therefore, the display driver can be used in display panels with signal lines having different pitches serving to receive drive signals and in addition, used in common in any of COF mounting and COG mounting which are different from each other in the pitch of mounting bumps. Further, selectable arrays being different in the condition of a pitch allocated for spacing between adjacent terminals of the external output terminals implies that a selectable array can be arranged even if the array pitch of a wiring pattern of amounting target to which the display driver is to be mounted is other than an integer multiple of the physical layout pitch of the external output terminals. Consequently, the selectable array variations are increased.

[8] Array Forms Different in the Number of External Output Terminals Used for Outputting Drive Signals In the display driver as described in [7], the more than one kind of arrays which can be selected by the control circuit further include an array of the external output terminals in which the number of external output terminals used for outputting drive signals is changed.

This embodiment further increases the selectable array variations.

[9] Using a Required Number of External Output Terminals from Both Ends of the External Output Terminal Array In the display driver as described in [7], the more than one kind of arrays which can be selected by the control circuit include an array in which the external output terminals used for outputting drive signals are arrayed from both ends toward the center thereof along a lengthwise direction of the array.

According to this embodiment, using a required number of external output terminals from both ends of an array of the external output terminals works to enlarge the inclination of a wiring pattern of a mounting target to which the display driver is mounted with respect to the array direction of the external output terminals, which prevents the wiring line pitch of the wiring pattern from being made extremely small.

[10] Line Latch Circuit and Drive Circuit

In the display driver as described in [7], the output circuit includes: a line latch circuit (44) having data registers arranged in parallel for holding pixel data; and a drive circuit (45) operable to produce, in units of pixel data, display drive signals from pixel data output by the line latch circuit and then provide the display drive signals to the external output terminals. The control circuit performs write address control for sequentially writing pixel data into the line latch circuit according to the output mode data and output control for outputting, in parallel, outputs of the data registers with pixel data written therein to the drive circuit.

According to this embodiment, the control for selecting an array of external output terminals from more than one kind of arrays different in layout pitch can be easily realized by the address control and output control by the control circuit.

[11] Sharing One External Output Terminal for Driving More than One Pixel

In the display driver as described in [10], the data registers each hold pixel data of more than one pixel as one unit. The drive circuit outputs drive signals corresponding to pixel data of more than one pixel output by the data registers in a time-sharing manner in the units of pixel data.

According to this embodiment, one external output terminal is shared to supply n pixels with display drive signals in a time sharing manner in case that one data register is holding pixel data of the n pixels, for example. This way enables the arrangement for leading out, in units of more than one line, signal lines of display elements of a high-resolution display panel to one piece of wiring pattern through a selector to connect to the corresponding external output terminal of the display driver. Thus, an array of external output terminals of the display driver can be arranged to have a pitch which enables the mounting of the display driver on a display panel with higher resolution.

[12] Array of External Output Terminals which can be Selected According to the Layout Pitch of an Electrode Pad Array of a Display Panel The display panel module (2, 3) has a display panel (6, 7) having display elements arrayed in a matrix form; and a display driver (1) formed as a semiconductor integrated circuit of an elongated shape, and supplying display drive signals to the display panel. The display driver includes: a plurality of external output terminals (S1-Sn) regularly disposed along a lengthwise direction of the display driver; an output circuit (46) operable to produce display drive signals to supply to the display panel from required external output terminals; an output mode register (60) on which output mode data (Mdata) are set overwritably; and a control circuit (43) operable to perform control for selecting an array of external output terminals to be used by the output circuit for outputting the display drive signals from more than one kind of arrays different in layout pitch according to the output mode data set on the output mode register. The more than one kind of arrays which can be selected by the control circuit include an array of the external output terminals in which the condition of a pitch allocated for spacing between adjacent terminals of external output terminals used for outputting drive signals is changed.

According to this embodiment, a display panel module is formed by use of the display driver which can be used in common to display panels different in the pitch of signal lines serving to receive drive signals from the display driver and in addition, used in common in any of COF mounting and COG mounting which are different from each other in the pitch of mounting bumps. So, the cutting of the cost of a display panel module can be achieved.

[13] Array Forms Different in the Number of External Output Terminals Used for Outputting Drive Signals In the display panel module as described in [12], the more than one kind of arrays which can be selected by the control circuit further include an array of the external output terminals in which the number of external output terminals used for outputting drive signals is changed.

This embodiment can further enlarge the scope in which the display driver can be shared and further increase the kind of display panel modules of which the cost can be cut.

[14] Using a Required Number of External Output Terminals from Both Ends of the External Output Terminal Array In the display panel module as described in [12], the more than one kind of arrays which can be selected by the control circuit include an array in which the external output terminals used for outputting drive signals are arrayed from both ends toward the center thereof along a lengthwise direction of the array.

According to this embodiment, using a required number of external output terminals from both ends of an array of the external output terminals works to enlarge the inclination of a wiring pattern of a mounting target to which the display driver is mounted with respect to the array direction of the external output terminals, which prevents the wiring line pitch of the wiring pattern from being made extremely small.

[15] Mounting of the Display Driver According to COG Form

In the display panel module as described in [12], the display driver is mounted on a glass substrate (9) of the display panel (6) according to a chip-on-glass (COG) form, and the external output terminals are directly bonded to a wiring pattern (12) on the glass substrate of the display panel.

According to this embodiment, the display driver can be mounted on a high-resolution display panel in COG form to constitute a high-resolution display panel module.

[16] Mounting of the Display Driver According to COF Form

In the display panel module as described in [12], the display driver is mounted on a flexible wiring board (5) connected to the display panel (7) according to a chip-on-film (COF) form, and the external output terminals are directly bonded to wiring lines (13) of the flexible wiring board, and connected to a wiring pattern on a glass substrate of the display panel.

According to this embodiment, the display driver can be mounted on a flexible wiring board connected to a low-resolution display panel according to COF form to constitute a low-resolution display panel module.

[17] Line Latch Circuit and Drive Circuit

In the display panel module as described in [12], the output circuit includes: a line latch circuit (44) having data registers arranged in parallel for holding pixel data; and a drive circuit (45) operable to produce, in units of pixel data, display drive signals from pixel data output by the line latch circuit and then provide the display drive signals to the external output terminals. The control circuit performs write address control for sequentially writing pixel data into the line latch circuit according to the output mode data and output control for outputting, in parallel, outputs of the data registers with pixel data written therein to the drive circuit.

According to this embodiment, the control for selecting an array of external output terminals from more than one kind of arrays different in layout pitch can be easily realized by the address control and output control by the control circuit.

[18] Sharing One External Output Terminal for Driving More than One Pixel

In the display panel module as described in [17], the data registers each hold pixel data (Di_Pn r, Di_Pn g, Di_Pn b, Di_Pn+1 r, Pn+1 g, Pn+1 b) of more than one pixel as one unit. The drive circuit outputs, in a time-sharing manner, drive signals corresponding to pixel data of more than one pixel output by the data registers in the units of pixel data. The display panel has select circuits (72) for supplying drive signals, sequentially output by the drive circuit in a time sharing manner, to signal lines of corresponding display elements in units of pixel data of corresponding pixels. The control circuit performs selective control for causing the select circuits to select the signal lines of the display elements corresponding to drive signals output in the time sharing manner in synchronization with the drive signal output by the drive circuit in the time sharing manner.

According to this embodiment, the signal line pitch of the display elements of the display panel can be made smaller than the smallest array pitch of the external output terminals of the display driver, whereby contribution can be made to the facilitation of the rise in resolution in regard to a display panel provided on a compact device such as a smart phone.

The effect achieved by the representative embodiment of the invention disclosed in the present application will be briefly described below.

It is possible to provide a display driver which can be used in common to display panels different in the pitch of external signal electrodes for drive signals and in addition, used in common in any of COF mounting and COG mounting. Further, it is possible to cut the cost of a display panel module.

EXAMPLE EMBODIMENTS

Figure 2:
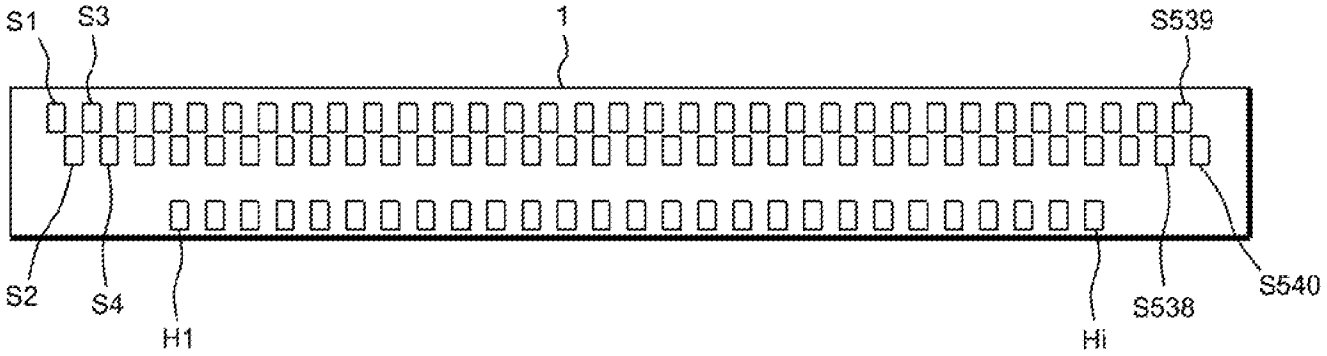
FIG. 2 is a plane view showing, by example, the appearance of a display driver according to one embodiment of the invention.

FIG. 2 shows, by example, the appearance of a display driver according to one embodiment of the invention. The display driver 1 shown in the diagram is formed as a semiconductor integrated circuit of an elongated shape, which is formed on, e.g., a single crystal silicon substrate according to a known CMOS integrated circuit manufacturing technique. The display driver 1 has the form of a so-called bare chip or a form referred to as "pellet". On a surface of the display driver 1, a plurality of external output terminals S1 to Sn are regularly arrayed near one of long sides along its lengthwise direction, whereas host interface terminals H1 to Hi are arrayed near the other long side along the lengthwise direction. In the diagram, e.g., n=540. The external output terminals S1 to Sn are ones for output of drive signals for driving the display panel. While the display driver 1 outputs other signals including timing signals to the display panel, the graphic representations of external output terminals for output thereof are omitted there.

Figure 3:
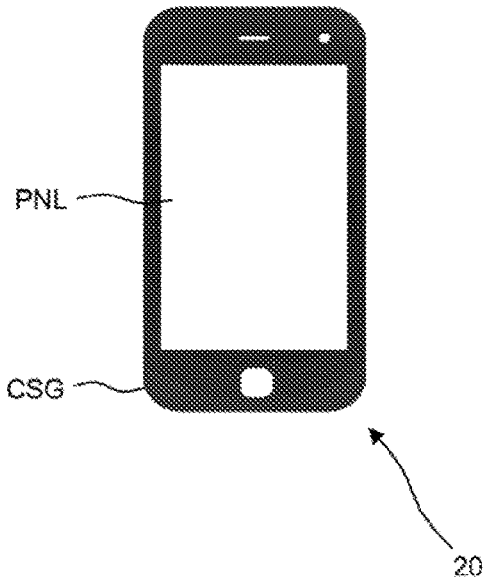
FIG. 3 is an explanatory diagram showing a smart phone to which the display driver is applied.
Figure 4:
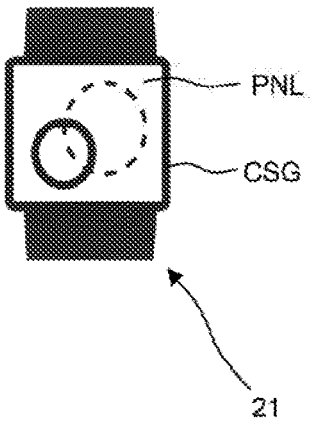
FIG. 4 is an explanatory diagram showing a smart watch to which the display driver is applied.
Figure 5:
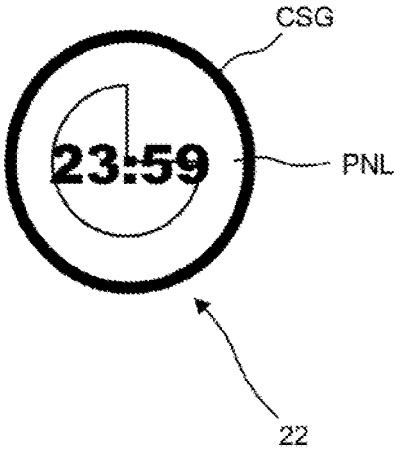
FIG. 5 is an explanatory diagram showing a free-form display to which the display driver is applied.

The display driver 1 can be used in common for driving display panels PNL of a smart phone 20 of FIG. 3, a smart watch 21 of FIG. 4, a free-form display 22 of FIG. 5 and the like. The display driver 1 and each display panel PNL are housed in a casing CSG together with other electronic devices. The size of the display panel PNL varies according to the size of an application product, such as a smart phone 20 or a smart watch 21 and the resolution required for display.

Figure 6:
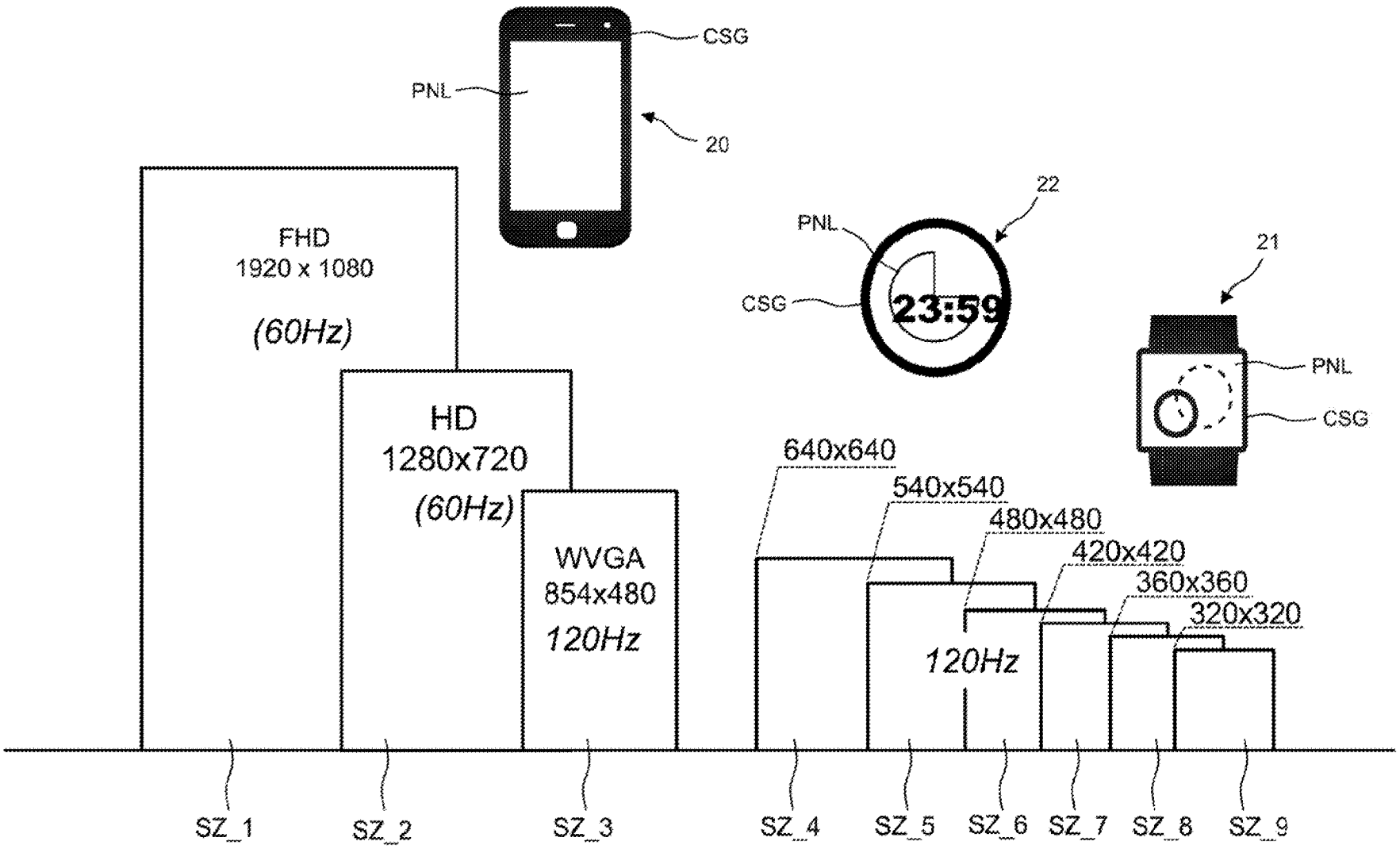

The typical resolutions of display panels used for a smart phone 20, a smart watch 21, a free-form display 22 and the like include those shown in FIG. 6. For instance, the resolution required for the smart phone 20 is FHD size of 1920×1080 pixels shown by RSL_1 of FIG. 6, HD size of 1280×720 pixels shown by RSL_2, or WVGA size of 854×480 pixels shown by RSL_3. To a smart watch 21 and a free-form display 22, e.g., a size of 640×640 pixels shown by RSL_4, a size of 540×540 pixels shown by RSL_5, a size of 480×480 pixels shown by RSL_6, a size of 420×420 pixels shown by RSL_7, a size of 360×360 pixels shown by RSL_8, and a size of 320×320 pixels shown by RSL_9 are applied.

Figure 7:
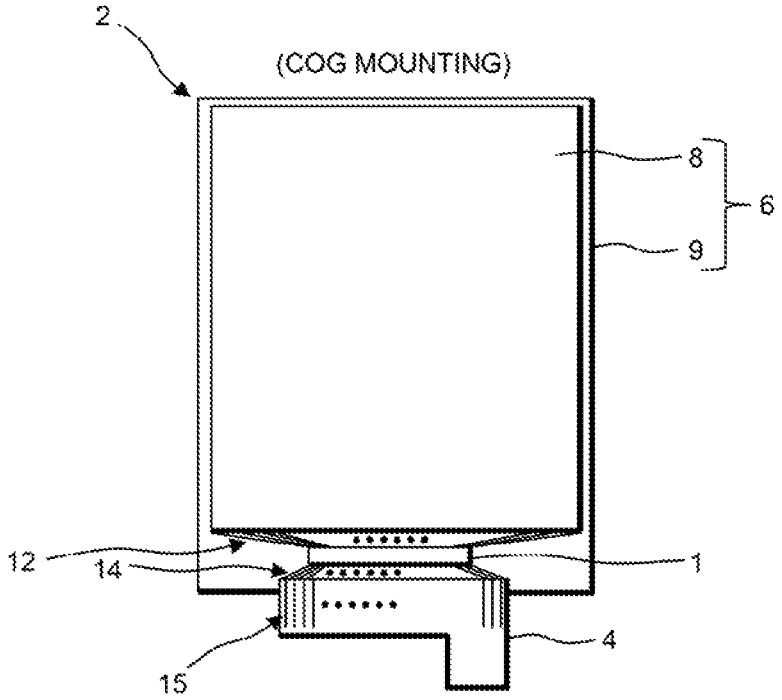
FIG. 7 is a plane view showing, by example, a display panel module arranged by use of a display panel to which COG mounting is applied.
Figure 8:
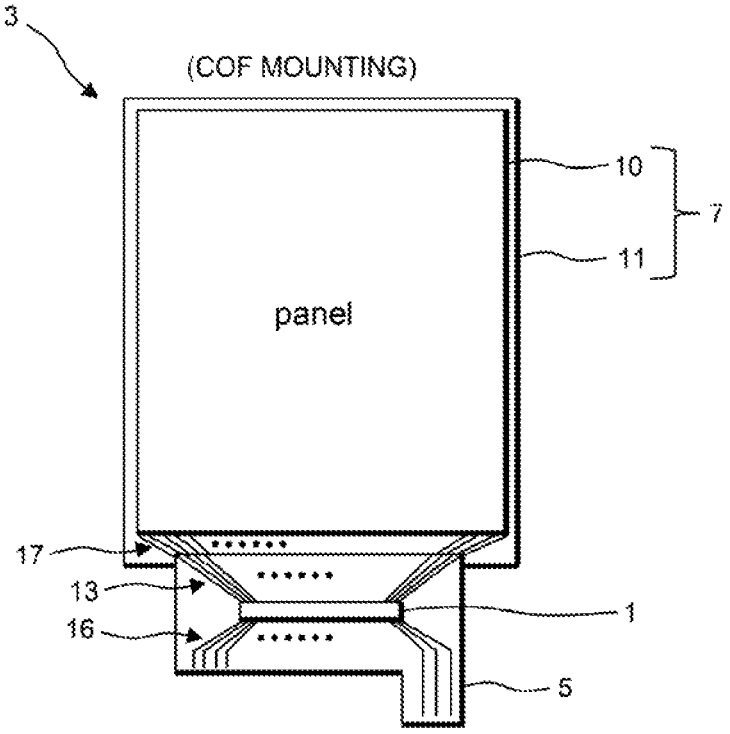
FIG. 8 is a plane view showing, by example, a display panel module arranged by use of a display panel to which COF mounting is applied.

The forms of mounting the display driver 1 on display panels of various resolutions are roughly classified into COG mounting of FIG. 7 and COF mounting of FIG. 8. Although no special restriction is intended, a display panel arranged by use of liquid crystal is taken as an example in each diagram.

FIG. 7 shows, by example, a display panel 6 (an example of the display panel PNL) to which COG mounting is applied. In the display panel 6, groups of transparent electrodes are arranged to be orthogonal to each another between an array substrate 9 and a filter substrate 8, each composed of a glass substrate; display elements are formed at their intersecting points; and liquid crystal is held between the substrates. As the material of the transparent electrodes, ITO (Indium-Tin-oxide) which is an oxide of indium and tin or the like is used. In this example, wiring patterns on the array substrate 9 are all composed of transparent wiring lines or electrodes which are arranged by use of ITO. On the filter substrate 8, RGB color filters are formed in turn for each row of the display elements; a total of three of display elements of RGB constitutes one pixel (picture element); and the display elements of RGB each form a sub-pixel (picture element). While not shown in the diagram, the group of transparent electrodes connected to select terminals of the display elements by the row are gate electrodes, and the group of transparent electrodes connected to data input terminals of the display elements by the column are source electrodes. The array substrate 9 has wiring patterns for mounting the display driver 1 formed thereon. The wiring patterns include: a wiring pattern (also, hereinafter referred to as "driving ITO lines" simply) 12 for connecting the source electrodes to all or part of the external output terminals S1 to Sn of the display driver 1 according to the resolution of the display panel; and a wiring pattern (also, hereinafter referred to as "host interface ITO lines" simply) 14 for connecting to the host interface terminals H1 to Hi of the display driver 1. The display driver 1 is mounted by: training the external output terminals S1 to Sn and the host interface terminals H1 to Hi downward; putting them on base end portions of the corresponding driving ITO lines 12, and end portions of the host interface ITO lines 14; and then fixing this state by press fitting with, e.g., anisotropically conductive film. The other end portions of the host interface ITO lines 14 are bonded to FPC lines 15 of an interface connector 4 arranged on FPC by press fitting with, e.g., anisotropically conductive film, whereby the display driver 1 is allowed to connect to a host device through the interface connector 4. The driving ITO lines 12 may be arranged to be in a one-to-one correspondence with the source electrodes. But, in one embodiment, with a high-resolution display panel with an increased number of source electrodes, it may be arranged so that more than one source electrode can be connected to each driving ITO line 12 through a selector, which can prevent the display driver 1 from being excessively elongated in size.

FIG. 8 shows, by example, a display panel 7 (another example of the display panel PNL) to which COF mounting is applied. The display panel 7 is arranged likewise, in which groups of transparent electrodes are arranged to be orthogonal to each other between an array substrate 11 and a filter substrate 10, each composed of a glass substrate; display elements are formed at their intersecting points; and liquid crystal is held between the substrates. On the filter substrate 10, RGB color filters are formed in turn for each row of the display elements; three display elements of RGB constitute one pixel (picture element); and the display elements of RGB each forma sub-pixel (picture element). While not shown in the diagram, the group of transparent electrodes connected to select terminals of the display elements by the row are gate electrodes, and the group of transparent electrodes connected to data input terminals of the display elements by the column are source electrodes. In COF mounting of FIG. 8, the display driver 1 is provided on a flexible wiring board 5. The flexible wiring board 5 has: wiring lines (also, hereinafter referred to as "panel interface FPC lines" simply) 13 for connecting to all or part of the external output terminals S1 to Sn of the display driver 1; and wiring lines (also, hereinafter referred to as "host interface FPC lines" simply) 16 for connecting the host interface terminals H1 to Hi of the display driver 1. On the flexible wiring board 5, the panel interface FPC lines 13 and host interface FPC lines 16 are formed by a method including lamination of a piece of aluminum or copper foil to a thin film of a resin such as polyimide. The display driver 1 is mounted by: training the external output terminals S1 to Sn and the host interface terminals H1 to Hi downward; putting them on base end portions of the corresponding panel interface FPC lines 13 and one end portions of the corresponding host interface FPC lines 16; and then fixing this state by press fitting with, e.g., an anisotropically conductive film. The display driver 1 is allowed to connect to a host device through the host interface FPC lines 16. The panel interface FPC lines 13 of the flexible wiring board 5 are connected to the driving ITO lines 17 formed on the array substrate 11 by press fitting with, e.g., an anisotropically conductive film. The driving ITO lines 17 are wiring lines for connecting the source electrodes of the display panel to all or part of the external output terminals S1 to Sn of the display driver 1 according to the resolution of the display panel. The driving ITO line 17 may be arranged to be in a one-to-one correspondence with the source electrodes. But, in one embodiment, with a high-resolution display panel with an increased number of source electrodes, it may be arranged so that more than one source electrode can be connected to each driving ITO line 17 through a selector, which can prevent the display driver 1 from being excessively elongated in size.

Figures 9, 15:
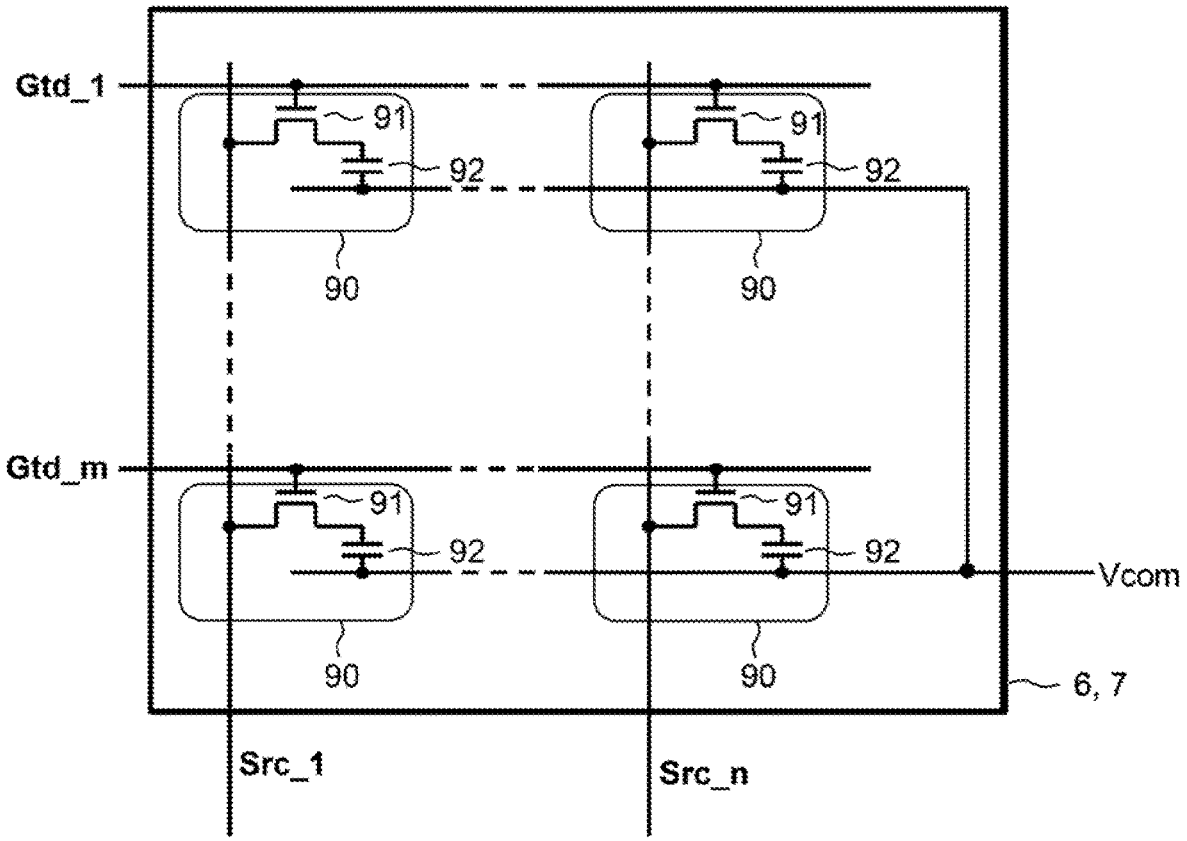
FIG. 9 is a circuit diagram showing, by example, a part of the circuit structure of the display panel used in each display panel module of FIGS. 7 and 8.
FIG. 15 is an explanatory diagram showing, by example, the data structure of a data array of display data arranged in units of 32 bits, in which data each consist of three kinds, RGB of unit display data, representing one corresponding pixel.

Now, the circuit structure of the display panel 6, 7 will be described below. As shown in FIG. 9, gate electrodes Gtd_1 to Gtd_m which are transparent electrodes arranged along X direction, and source electrodes Src_1 to SRC_n which are transparent electrodes arranged along Y direction are formed; and display elements 90 are formed at their intersecting points. Each display element 90 includes: a thin film switch transistor 91 formed in the array substrate 9, 11; and a capacitance component 92 connected in series therewith. The select terminal of the thin film switch transistor 91 is coupled to the corresponding one of the gate electrodes Gtd_1 to Gtd_m, and the data input terminal of the thin film switch transistor 91 is coupled to corresponding one of the source electrodes Src_1 to SRC_n. The capacitance component 92 represents a capacitance component of a combination of the liquid crystal of the display element and a storage capacitance thereof, and has one electrode of the capacitance connected in series with the corresponding thin film switch transistor 91, and the other electrode bonded to a common voltage signal line Vcom. The display elements 90 are selected by the gate electrodes in units of the display line shared by the gate electrodes. The selected display elements 90 are supplied with drive signals from the source electrodes Src_1 to SRC_n in parallel, which are accumulated by the capacitance components 92. According to the voltages of the drive signals thus accumulated, the needle inclination degrees of the liquid crystal are controlled. The display is performed by the pixels with the gradations according to the controlled needle inclination degrees. The pitch of the source electrodes Src_1 to SRC_n varies according to the resolution of the display panel 6, 7 and its panel size. The source electrodes Src_1 to SRC_n and the gate electrodes Gtd_1 to Gtd_m are all ITO lines. As described above, the source electrodes Src_1 to SRC_n are in a one-to-one correspondence with the driving ITO lines, or organized into groups each group including more than one source electrode and connected to each driving ITO line through a switch in units of the group. Incidentally, the selection of select the switch may be synchronized with the timing of the supplying display drive signals to the source electrodes from the display driver 1 and as such, switch select signals therefor are supplied by, e.g., the display driver 1.

FIG. 1 shows, by example, the driving ITO lines 12 directly bonded to the external output terminals S1 to Sn of the display driver 1 in the COG mounting form, and the panel interface FPC lines 13 directly bonded to the external output terminals S1 to Sn of the display driver 1 in the COF mounting form. The driving ITO lines 12 formed on the array substrate 9 for COG mounting can be formed with high precision, i.e., with a narrow pitch by photolithography or the like. As an example of the pattern pitch of the driving ITO lines 12, 10 μm is noted in FIG. 1. In contrast, the panel interface FPC lines 13 and host interface FPC lines which are to be formed on the panel wiring board 5 for COF mounting are formed by gluing a piece of copper or aluminum foil to a film substrate. So, their machining precisions are lower than those of the driving ITO lines 12 and others formed on the glass substrate 9, and the narrow pitch as achieved in COG mounting cannot be realized. In FIG. 1, the wiring line pitch of the panel interface FPC lines 13 is made, e.g., 20 μm.

According to a comparison made between COG mounting and COF mounting, there are differences therebetween chiefly as follows. As shown in FIG. 10 by example, COG mounting is wider than COF mounting in display panel module edge. This is because COG mounting uses a mounting region on a glass substrate. As to the pitch of wiring lines on which the display driver is provided, i.e., the pitch (output bump pitch) of external output terminals used for mounting, COG mounting can be made narrower than COF mounting. Further, in regard to the cost of the display panel module, COF mounting is costlier than COG mounting. This is because COF mounting uses the preparation of the flexible wiring board 5 for COF mounting.

The display drivers 1 which are used for COG mounting and COF mounting in FIG. 1 respectively are identical to each other. For instance, the external output terminals S1 to S540 are arranged in a couple of front and rear rows; the pitch of each row is 20 μm, and the front and rear rows are displaced from each other by 5 μm. That is, the pitch between adjacent terminals of front row's external output terminals S1 to S539 having odd terminal numbers is 20 μm, and the pitch between adjacent terminals of rear row's external output terminals S2 to S540 having even terminal numbers is likewise 20 μm; and in the external output terminals S1 to S540, the pitch between terminals having adjacent terminal numbers is 10 μm as to the front and rear rows on the whole. The display driver 1 arranged for COG mounting of FIG. 1 is operated in an operation mode in which of the external output terminals S1 to S540, a required number of terminals in the front and rear rows are used for outputting display drive signals to the driving ITO lines 12 having a pitch of 10 μm. On the other hand, the display driver 1 arranged for COF mounting of FIG. 1 is operated in an operation mode in which of the external output terminals S1 to S540, a required number of terminals in the front and rear rows are used for outputting display drive signals to the interface FPC lines 13 having a pitch of 10 μm.

The form of utilizing the external output terminals S1 to S540 according to the resolution of a display panel using the display driver 1 can be changed between COG mounting and COF mounting as shown in FIG. 11. Specifically, in the case of FHD resolution, all the external output terminals S1 to S540 are used according to COG mounting. Although no special restriction is intended, one source electrode is selected by a selector or switch from six source electrodes of two pixels (six display elements corresponding to six subpixels), and connected to one driving ITO line in this case. Therefore, 540 external output terminals are used for performing the display driving of a display panel of FHD of 1080 pixels. In contrast, in one embodiment, it is unrealistic to apply COF mounting to a display panel of FHD resolution and therefore, such a display panel may not be supported.

With the resolution of HD, the external output terminals S1 to S180 in the left-end portions of arrays of the external output terminals S1 to S540, and the external output terminals S360 to S540 in the right-end portions are used for COG mounting. In the case of partially using the external output terminals S1 to S540, a required number of external output terminals at positions ranging from the two opposing ends of the terminal arrays toward the centers thereof should be used. Using a required number of external output terminals from the two opposing ends of the external output terminal arrays like this increases the inclination of the wiring lines 12 and 13 of a mounting target, to which the display driver 1 is to be mounted, with respect to the array direction of the external output terminals, thereby preventing the wiring line pitch of the wiring lines 12 and 13 from being made extremely small.

With the resolution of WVGA or lower, the number of external output terminals to be used for COG mounting is different from that in the case of the HD resolution.

In COF mounting of the display driver 1, the pitch of the panel interface FPC lines 13 is 20 μm, which is twice the pitch in COG mounting and therefore, of the external output terminals S1 to S540, the external output terminals S1, S3, . . . , S537, S539 of the front row, each having an odd terminal number are used. For instance, in the case of WVGA, the consecutive external terminals S1 starting on the left end of the external terminal array are used, provided that the subscript "i" represents a terminal number and satisfies i=2n+1 (where n is 0 to 119); and the consecutive external terminals S1 starting on the left end of the external terminal array are used, provided that the terminal number "i" satisfies i=539−2n (where n is 119 to 0). The same thing applies to the cases of lower resolutions. In the case of 540×540 resolution, the terminal number of the external output terminals S1 to be used is in a range of i=2n+1 (where n is 0 to 269). In the case of 420×420 resolution, the terminal number "i" of the external output terminal Si to be used, starting on the left end is in a range of i=2n+1 (where n is 0 to 104), and the terminal number "i" of the external output terminal Si to be used, starting on the right end is in a range of i=2n+1 (where n is 104 to 0). In the case of 360×360 resolution, the terminal number "i" of the external output terminal Si to be used, starting on the left end is in a range of i=2n+1 (where n is 0 to 89), and the terminal number "i" of the external output terminals S1 to be used, starting on the right end is in a range of i=2n+1 (where n is 89 to 0).

In the description presented with reference to FIG. 11, the display driver 1 arranged so that the terminal pitch (20 μm) between terminal arrays of front and rear rows is made twice the terminal pitch (10 μm) between adjacent terminals of the external output terminals S1 to S540 has been taken as an embodiment, in which according to the terminal pitch arrangement, the wiring line pitch in COF mounting has been assumed to be double that in COG mounting for the sake of convenience. The invention is not limited to the embodiment in reality. The wiring line pitch in COF mounting can be expected not to be an integer multiple of the wiring line pitch in COG mounting. Further, the wiring line pitch per se can be expected not to be 10 or 20 μm as well. In such cases, the display driver 1 may be mounted while utilizing the external output terminals which can be put on the wiring lines of a mounting target. For instance, the display driver may be mounted in such a way that the external output terminals in an external output terminal array are put out of use at a rate of one in "m" terminals.

The display driver 1 has the function of variably controlling what drive signal to output from which external output terminal according to its mounting form, in order to adapt to both of COG mounting and COF mounting and further to flexibly adapt to mountable wiring line pitches. The configuration of the display driver 1 which enables the materialization of the function will be described below.

Figure 12:
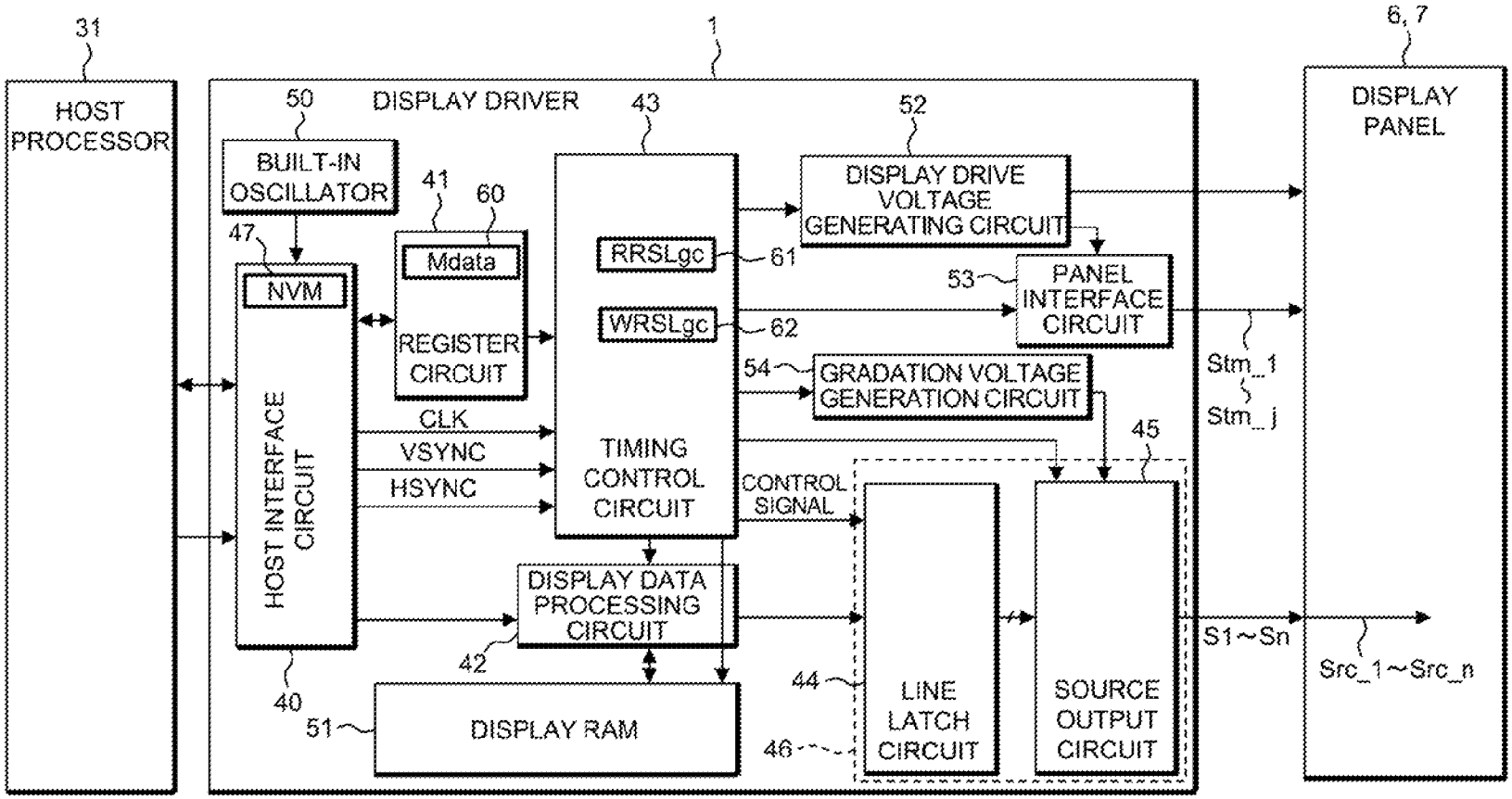
FIG. 12 is a block diagram showing, by example, the configuration of the display driver.

FIG. 12 shows, by example, the configuration of the display driver 1.

The display driver 1 receives a command for instructing a display action and display data from a host processor 31. The display driver 1 operates according to the received command, and performs control for displaying an image on the display panel 6 or 7 based on the display data and others. The display driver 1 accepts the input of image data from the host processor 31, and performs control to output timing signals for sequentially scanning the pixels in units of the display line by gate electrode lines Gtd_1 to Gtd_m and to supply the pixels of each scan-driven display line with drive signals as gradation signals according to the display data in such a way that the drive signals are supplied to source electrode lines Src_1 to Src_n in parallel in synchronization with the display timing. While not particularly shown in the diagram, a gate driver operable to drive the gate electrode lines Gtd_1 to Gtd_m is provided on the display panel separately from the display driver 1; the display driver outputs a drive timing signal for driving the gate electrode lines to the gate driver. The drive timing signal is part of the timing signals Stm_1 to Stm_j.

Although no special restriction is intended, the display driver 1 has: a host interface circuit 40; a register circuit 41; a display data processing circuit 42; a timing control circuit 43; a line latch circuit 44; a source output circuit 45; a built-in oscillator 50; a display RAM 51; a display drive voltage generating circuit 52; a panel interface circuit 53; and a gradation voltage-producing circuit 54.

The host interface circuit 40 receives display data, a command, control data and various kind external timing signals from the host processor 31. The host interface circuit produces, based on received external timing signals, clock signals CLK serving as internal timing signals, vertical synchronizing signals VSYNC and horizontal synchronizing signals HSYNC and supplies them to the timing control circuit 43. The host interface circuit 40 stores the command and control data received from the host processor 31 in the register circuit 41. Some control data including initial set data are loaded from a nonvolatile memory circuit (NVM) 47 in the host interface circuit 40. The timing control circuit 43 performs display control based on timing signals given from the host interface circuit 40, and the command and control data transmitted from the register circuit 41. The clock signals CLK are dot clock signals which are matched with dot clocks.

The display data can be supplied as video stream data, or supplied in units of the word according to a bus access cycle. The supplied data are subjected to, e.g., a filter operation in a display data processing part 42 on an as-needed basis. The display data supplied according to the bus access cycle are stored in the display RAM 51, e.g., in units of the display frame. The display data stored in the display RAM 51 are read out therefrom in synchronization with a display timing. The read display data are latched by the line latch circuit 44 for each display line in series. Display data supplied in the form of video stream data are latched by the line latch circuit 44 in synchronization with the display timing in series. The timing control circuit 43 performs the latch address control on the line latch circuit 41. The source output circuit 45 accepts inputs of display data latched by the line latch circuit 44 in parallel, and then outputs drive signals of gradation voltages according to the display data to the display panel 6 or 7. In parallel, the drive signals may be output to the driving ITO lines 12 on condition that the display driver 1 is mounted by COG mounting, whereas the drive signals are output to the panel interface FPC lines 13 on condition that the display driver is mounted by COF mounting. The gradation voltages are produced by the gradation voltage-producing circuit 54, which are then passed to the source output circuit 45. The line latch circuit 44 and the source output circuit 45 constitute an embodiment of an output circuit 46 for producing display drive signals to supply to the display panel 6, 7 from required terminals of the external output terminals S1 to S540.

The built-in oscillator circuit 50 outputs clock signals for to define the internal timing of the display driver 1. The display drive voltage generating circuit 52 outputs gate drive voltages and voltages of the common voltage signal lines, which are required in the display panel. The panel interface circuit outputs timing signals Stm_1 to Stm_j.

Figure 13:
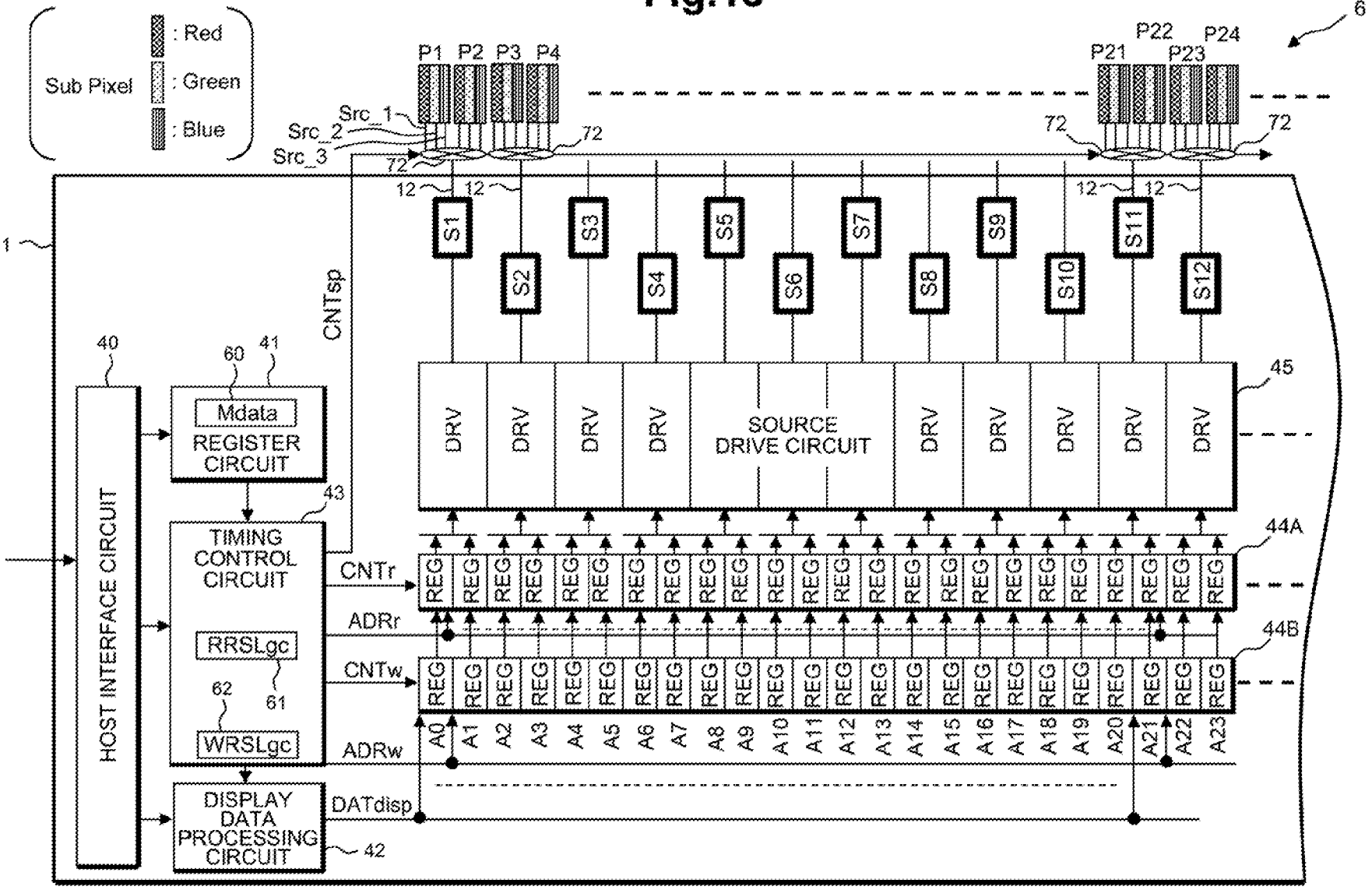
FIG. 13 is a block diagram showing, by example, details of an output circuit on condition that the display driver is mounted, by COG mounting, on a display panel of FHD resolution.

FIG. 13 shows, by example, details of the output circuit 46 on condition that the display driver 1 is mounted on the display panel 6 of FHD resolution by COG mounting. P1, P2, . . . represent pixels of the display panel 6; each pixel has sub-pixels composed of display elements 90 of R (Red), G (Green) and B (Blue). Although no special restriction is intended, in this embodiment the source electrodes Src_1 to Src_n are connected, in units of the set of six electrodes, i.e., two pixels, through one selector 72 to one driving ITO line 12. Each selector 72 sequentially selects the source electrodes one by one in the order of RGBRGB according to select signals CNTsp output from the timing control circuit 43. The select signals CNTsp are signals which the timing signals Stm_1 to Stm_j include.

In the case of mounting the display driver on the display panel 6 of FHD resolution by COG mounting, the external output terminals S1 to S540 will be connected to the corresponding driving ITO lines 12 to perform the COG mounting, as described on connection forms with reference to FIG. 11.

The source drive circuit 45 has drivers DRV which are in one-to-one correspondence with the external output terminals S1 to S540. While not particularly shown in the diagram, each driver DRV is a circuit which receives display data in units of more than one bit, e.g., eight bits representing gradations and then, outputs gradation voltages corresponding to them from an output buffer.

The line latch circuit 44 is configured to have two stages including an input-stage line latch circuit 44B and an output-stage line latch circuit 44A. The input-stage line latch circuit 44B and the output-stage line latch circuit 44A each have 540 32-bit registers REG which hold three kinds, RGB of unit display data in pixels, i.e. groups of three sub-pixels. Each register REG is assigned addresses A0 to A539.

Although no special restriction is intended, display data DATdisp are supplied to the data input terminal of each register REG of the input-stage line latch circuit 44B through a 32-bit internal bus in units of 32 bits. The display data DATdisp supplied through the internal bus are written into the register REG specified by a write address ADRw. The write timing thereof is controlled by a write enable signal CNTw. The display data DATdisp arranged in units of 32 bits are made D0, D1, D2, . . . in turn as shown by example in FIG. 15; each piece of the data includes three kinds, RGB of unit display data of the corresponding one pixel. For instance, the data D0 includes R data D0_P1*r*, G data D0_P1*g* and B data D0_P1*b* of the pixel P1, and the data D1 includes R data D1_P2*r*, G data D1_P2*g* and B data D1_P2*b* of the pixel P2.

The display data DATdisp are transmitted to each register REG of the output-stage line latch circuit 44A from the corresponding register REG of the input-stage line latch circuit 44B in units of 32 bits. In the output-stage line latch circuit 44A, the register REG specified by a read address ADRr is targeted for readout. The read action is performed for each unit display data, namely in units of 8 bits; the read timing thereof is controlled by a read enable signal CNTr.

The outputs of a pair of adjacent registers REG of the output-stage line latch circuit 44A are connected to an input terminal of the driver DRV of the subsequent stage through a wired OR or selector.

The write action of one display line of display data DATdisp on the registers REG of the input-stage line latch circuit 44B is performed in a horizontal synchronization period, and the read action of one display line of display data on the registers REG of the output-stage line latch circuit 44A is performed in the subsequent horizontal synchronization period. Although no special restriction is intended, it is appropriate to arrange the read action on the registers REG of the output-stage line latch circuit 44A so as to sequentially select the registers REG of the output-stage line latch circuit 44A, and sequentially read therefrom three kinds, RGB of unit display data of the selected register REG during one display period. In this case, it is appropriate to sequentially select the source electrodes by the selector 72 at a speed which represents three times the cycle of selecting the registers REG of the output-stage line latch circuit 44A. Alternatively, it is possible to perform the read in such a way that three kinds, RGB of unit display data of the registers REG of odd numbers are selected in turn during the first half period of one display period, and three kinds, RGB of unit display data of the registers REG of even numbers are selected in turn during the second half period, provided that the display quality becomes low.

The timing control circuit 43 has a control logic serving to variably select which register REG to write display data into from the registers of the input-stage line latch circuit 44B and accordingly, which register REG of the output-stage line latch circuit 44A to read display data from. Specifically, the control logic includes: a write register address creating logic (WRSLgc) 62 which controls the position to write display data on the input-stage line latch circuit 44B according to output mode data Mdata set in an output mode register 60 of the register circuit 41; and a read register address creating logic (RRSLgc) 61 which controls the position to read display data on the output-stage line latch circuit 44A. The write register address creating logic 62 creates a write address ADRw according to the mode data Mdata, whereas the read register address creating logic 61 creates a read address according to the mode data Mdata. Although no special restriction is intended, the register address creating logics 61 and 62 are each configured by a program sequence control logic, which does not intend that the register address creating logic be prohibited from being formed by a hard wired logic.

In the control by the register address creating logics 61 and 62, the creation of the write address ADRw and the read address ADRr is controlled according to the output mode data Mdata set in the output mode register 60 so as to select an array of the external output terminals S1 to S540 which the output circuit 46 should use to output display drive signals from more than one kind of arrays different in layout pitch. In other words, the register address creating logics 61 and 62 variably control the register position (input position) to write display data into the input-stage line latch circuit 44B along an array direction of the external output terminals S1 to S540, and the register position (output position) to read display data from the output-stage line latch circuit 44A, according to the mode data Mdata, thereby making possible to select the array of the external output terminals S1 to S540 to use to output display data from more than one kind of arrays different in layout pitch.

The forms of arrays of the external output terminals S1 to S540 which the register address creating logics 61 and 62 can select according to the mode data Mdata include, e.g., the array forms shown in FIG. 11. Unique mode numbers are assigned to the combination of COG mounting and FHD resolution, the combination of COG mounting and HD, the combination of COG mounting and WVGA, the combination of COF mounting and WVGA, and the other conditions respectively. The mode numbers are set on the mode register 60. The register address creating logics 61 and 62 decrypt the mode numbers as commands, thereby creating, e.g., the corresponding write address ADRw and the corresponding read address ADRr. The other timing signals including action enable signals and select signals required for register write and read are produced by a control logic, not shown in the diagram, in the timing control circuit 43 based on the mode data Mdata.

The connection form of the external output terminals S1 to S540 when the combination of COG mounting and FHD is specified is as shown in FIG. 13. The external output terminals S1 to S540 of each row of a couple of front and rear rows are connected to the corresponding driving ITO lines 12. The relation among the pixel, the external output terminal used for output thereof, pixel data, and the address of the register REG holding the pixel data during this time is as shown by example in FIG. 14. A relation similar to the above one holds in the combination of COG mounting and HD, the combination of COG mounting and WVGA, the combination of COG mounting and 540×540 resolution, the combination of COG mounting and 420×420 resolution, and the combination of COG mounting and 360×360 resolution; the display driver is arranged so that just a required number of the external output terminals are utilized from an end in turn, corresponding to the array of the registers REG.

Figure 16:
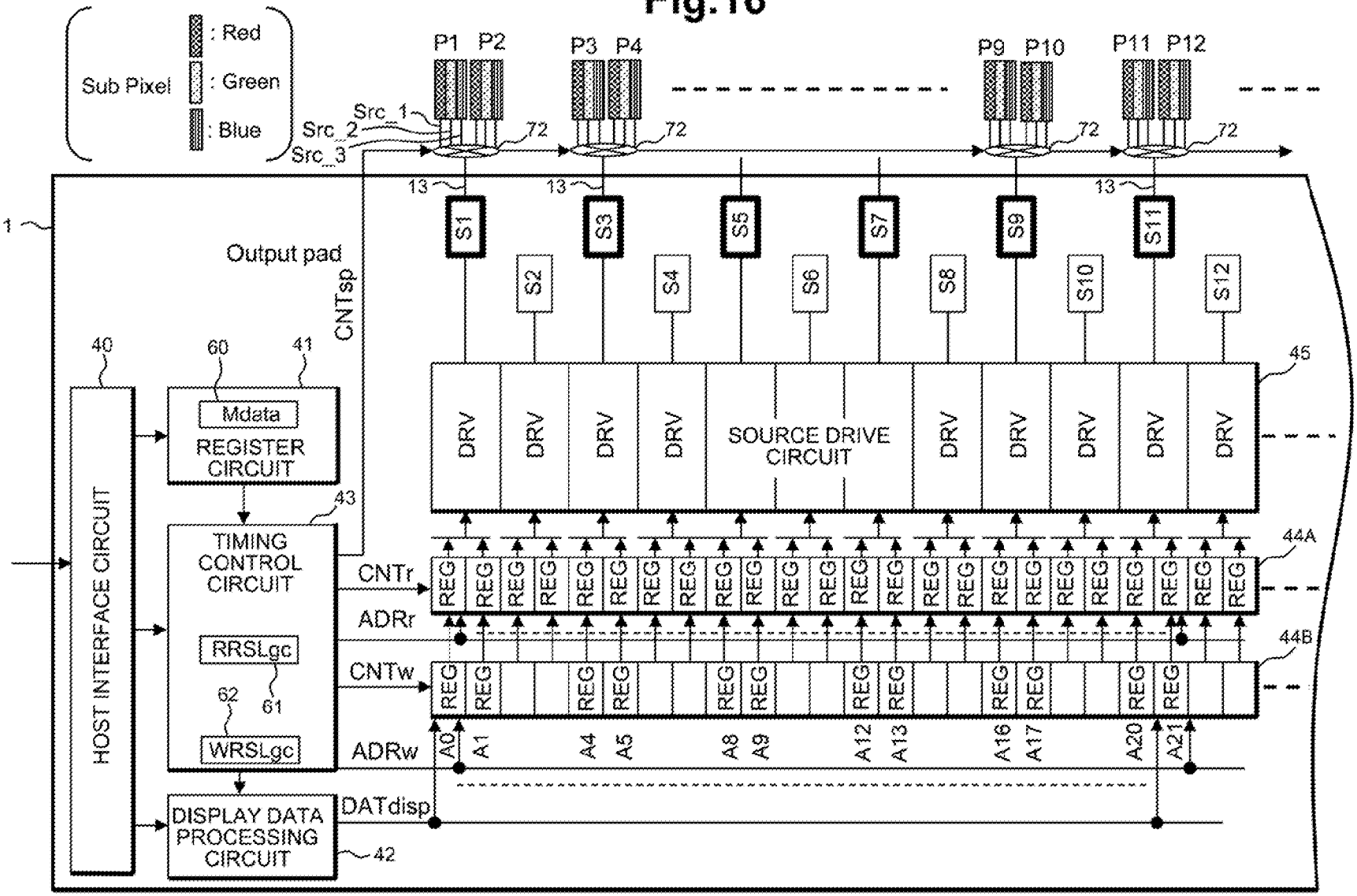
FIG. 16 is a block diagram showing, by example, the connection form of external output terminals when the combination of COF mounting and WVGA resolution is specified by mode data.

The connection form of the external output terminals S1 to S540 when the combination of COF mounting and WVGA is specified is as shown in FIG. 16. A required number of the external output terminals S1, S3, S5, . . . in one row, which are located in the front row and odd in terminal number are connected to the driving ITO lines 12. The relation among each pixel, the external output terminal used for output thereof, pixel data, and the address of the register REG holding the pixel data during this time is as shown by example in FIG. 17. The external output terminal S1 is used for the output of the pixels P1 and P2, and the addresses A0 and A1 are used as write and read register addresses of the pixel data D0 and D1 output therefrom; the external output terminal S3 is used for the output of the pixels P3 and P4, and the addresses A4 and A5 are used as write and read register addresses of the pixel data D2 and D3 output therefrom; and the external output terminal S2 between the used external output terminals, and the registers of the addresses A2 and A3 are left unused. The same thing applies to other pixels. A relation similar to the above one holds in the combination of COF mounting and WVGA, the combination of COF mounting and 540×540 resolution, the combination of COF mounting and 420×420 resolution, and the combination of COF mounting and 360×360 resolution;

the display driver is arranged so that just a required number of the external output terminals are utilized from an end in turn, corresponding to the array of the registers REG.

Figure 18:
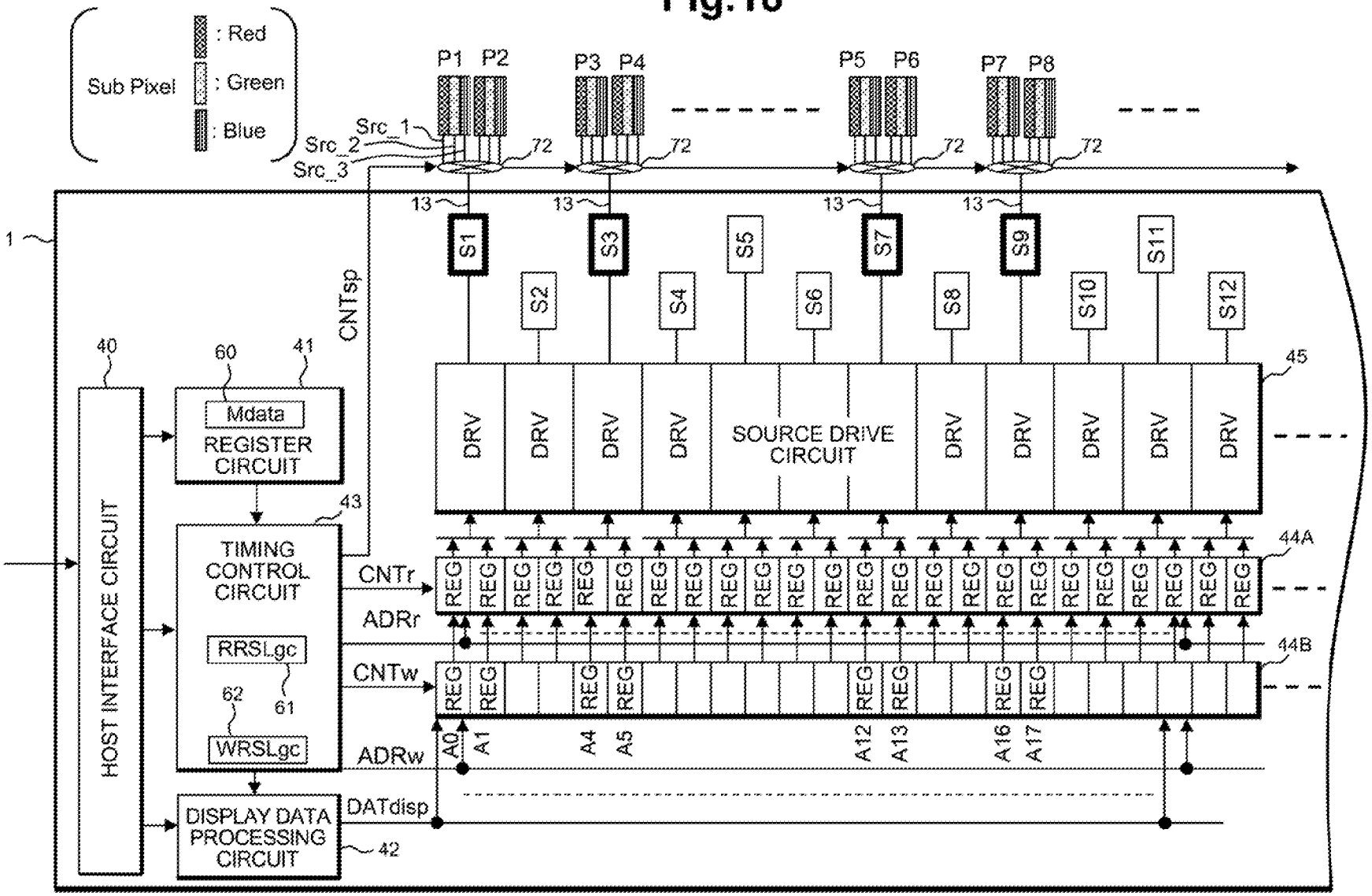
FIG. 18 is a block diagram showing, by example, the connection form of external output terminals in a mounting form arranged so that the pitch error is absorbed by making connection in such a way that one terminal per a given number of the external output terminals is left unused in the case of using a flexible wiring board of which the pitch of panel interface FPC lines is slightly different from the pitch of a front row of an external output terminal array of the display driver.
Figure 19:
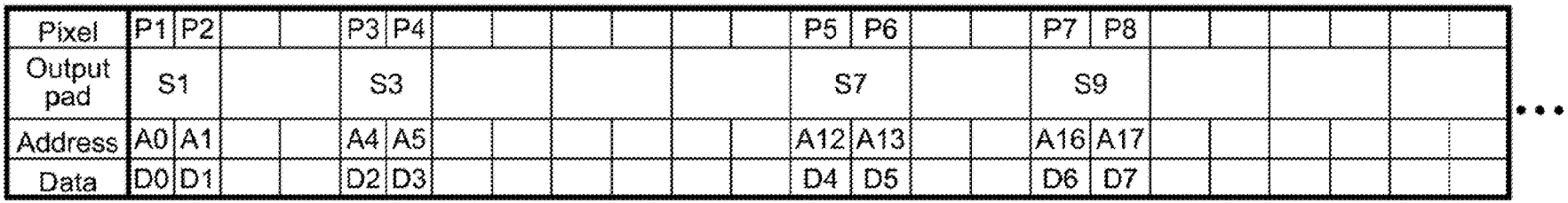
FIG. 19 is an explanatory diagram showing the relation among each pixel, the external output terminal used for output thereof, pixel data, and the address of the register REG holding the pixel data in the connection form of FIG. 18.

FIG. 18 shows, by example, another connection form adapted to an operation mode. The above description is based on the assumption that the pitch of the panel interface FPC lines 13 is equal to the pitch of front row's terminal array as shown in FIG. 1, whereas the use of a flexible wiring board 5 with panel interface FPC lines 13 having a pitch slightly different from the pitch of front row's terminal array is assumed in this embodiment. In this case, the pitch error can be absorbed by connecting the panel interface FPC lines to the external output terminals so that one terminal per a given number of the external output terminals is left unused. In the connection form of FIG. 18, one terminal per two external output terminals is left unused in the external output terminal array of the front row. If a variation of the pitch of the panel interface FPC lines 13 from the array pitch of the external output terminals is known, every what ordinal number of the external output terminal to leave unused can be known in advance. Therefore, it is appropriate to decide the operation mode according to the relation thereof in advance and then, incorporate a control sequence according to the operation mode into the control circuit 43. The relation among each pixel, the external output terminal used for output thereof, pixel data, and the address of the register REG holding the pixel data during this time is as shown by example in FIG. 19. The external output terminal S1 is used for the output of the pixels P1 and P2, and the addresses A0 and A1 are used as write and read register addresses of the pixel data D0 and D1 output therefrom; the external output terminal S3 is used for the output of the pixels P3 and P4, and the addresses A4 and A5 are used as write and read register addresses of the pixel data D2 and D3 output therefrom; and the external output terminal S2 between the used external output terminals, and the registers of the addresses A2 and A3 are left unused. Further, the external output terminal S7 is used for the output of the subsequent pixels P5 and P6, and the addresses A12 and A13 are used as write and read register addresses of the pixel data D4 and D5 output therefrom; and the external output terminals S4 to S6 between the used external output terminals and the registers of the addresses A6 to A11 are left unused.

With the display driver 1 as described above, one array can be selected from more than one kind of arrays different in layout pitch as the array of the external output terminals S1 to S540 used for outputting display drive signals when driving the display panel based on the mode data Mdata. Specifically, the control circuit 43 is arranged to be able to change a write register position for writing pixel data into the line latch circuit 44B, and a read register position for reading pixel data from the line latch circuit 44A according to an array direction of the external output terminals S1 to S540. Therefore, it is appropriate to set the mode data Mdata on the mode register 60 so as to fit the pitch of the driving ITO lines 12 or panel interface FPC lines 13 to which the display driver 1 is mounted, and select the array of the external output terminals to use for outputting display drive signals from more than one kind of arrays different in layout pitch. Hence, the display driver 1 can be used in common to display panels different in the pitch of signal lines serving to receive drive signals from the display driver 1 and in addition, used in common in any of COF mounting and COG mounting which are different from each other in the pitch of wiring lines, such as the driving ITO lines 12 or panel interface FPC lines 13, on which the display driver is to be mounted. This contributes to the cutting of the cost of display panel modules as shown in FIGS. 7 and 8.

In addition, the more than one kind of arrays which can be selected by the control circuit 43 according to the mode data Mdata include an array of the external output terminals S1 to S540 in which the condition of a pitch allocated for spacing between adjacent terminals of external output terminals used for outputting drive signals is changed, and the external output terminals used for outputting drive signals are arrayed from both ends toward the center thereof along a lengthwise direction of the array. Examples of such arrays are the array described with reference to FIGS. 18 and 19. Selectable arrays being different in the condition of a pitch allocated for spacing between adjacent terminals of the external output terminals S1 to S540 like this implies that an array which can be selected even if the array pitch of a wiring pattern of a mounting target to which the display driver 1 is to be mounted is other than an integer multiple of the physical layout pitch of the external output terminals S1 to S540 can be arranged. Consequently, the selectable array variations are increased. Using a required number of external output terminals from both ends of an array of the external output terminals S1 to S540 works to enlarge the inclination of a wiring pattern (the driving ITO lines 12 in FIG. 7, and the panel interface FPC lines 13 in FIG. 8) of a mounting target to which the display driver 1 is mounted with respect to the array direction of the external output terminals S1 to S540, which is preferred in order to prevent the wiring line pitch of the wiring pattern from being made extremely small.

Further, the more than one kind of arrays which the control circuit 43 can select based on the mode data Mdata include an array of the external output terminals S1 to S540 in which the number of external output terminals used for outputting drive signals is changed, and the external output terminals used for outputting drive signals are arrayed from both ends toward the center thereof along a lengthwise direction of the array, as described with reference to FIG. 11. Consequently, the selectable array variations are increased.

In addition, as described based on FIG. 13, the arrangement for leading out, in units of more than one line, signal lines Src_1 to Src_n of display elements 90 arranged in a high-resolution display panel 6 to one wiring line 12 or 17 through the selector 72 to connect to the corresponding external output terminal of the display driver 1 is enabled by sharing one external output terminal for more than one pixel, e.g., sharing one external output terminal for supplying n pixels with display drive signals in a time sharing manner in a case where one data register is holding pixel data of the n pixels. In this way, the pitch of an array of the external output terminals of the display driver 1 can be prevented from being narrowed extremely even with the increase in resolution of a display panel 6 and thus, the pitch which enables the mounting of the display driver can be maintained.

Figure 20:
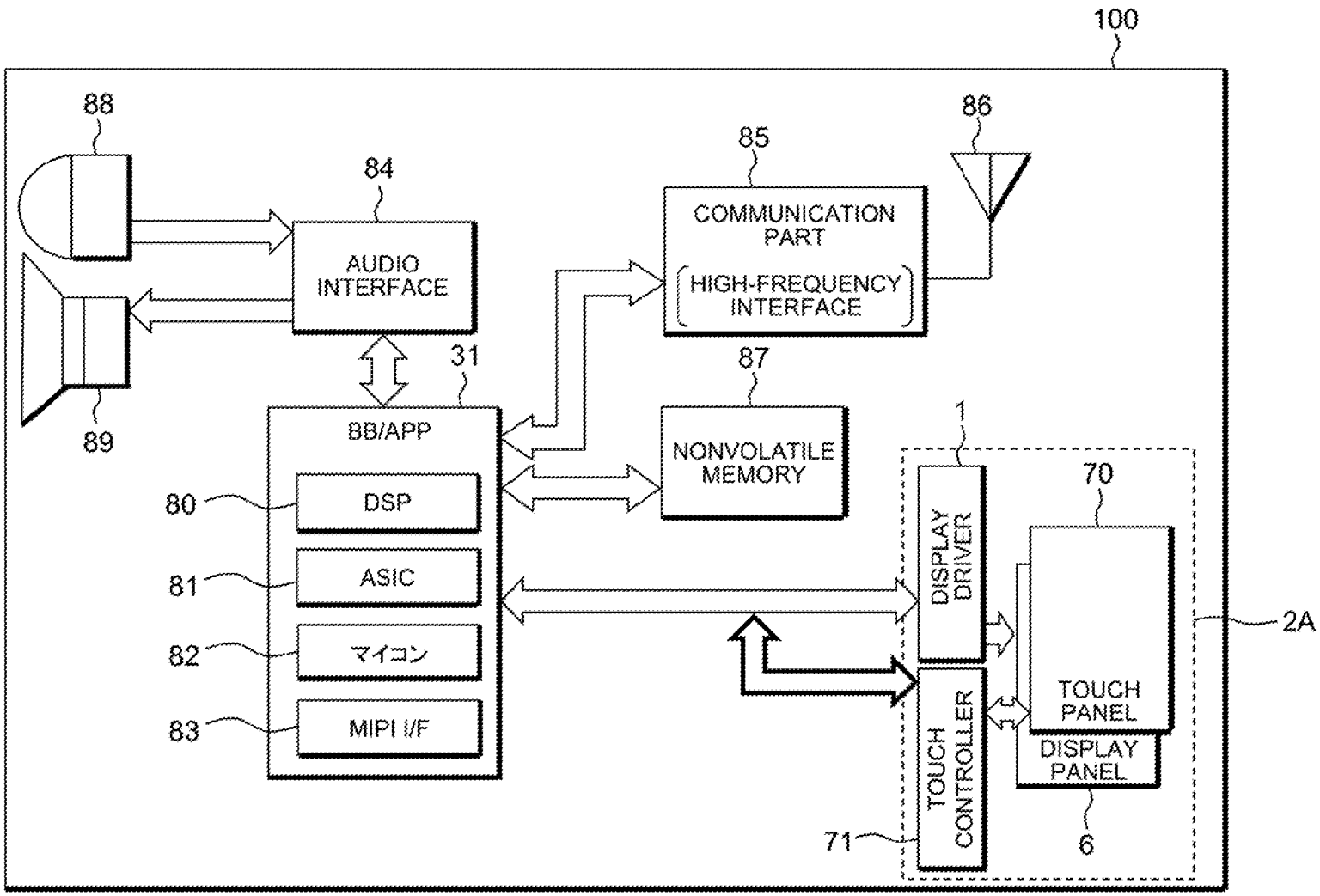
FIG. 20 is a block diagram showing, by example, an electronic device arranged by use of the display panel module.

FIG. 20 shows, by example, an electronic device 100 arranged by use of a display panel module. In this embodiment, a portable terminal device is taken as an example of the electronic device 100. In this embodiment, the display panel module 2A includes a touch panel 70 and a touch controller 71 in addition to the display panel 6 and the display driver 1. Although no special restriction is intended, the touch panel 70 is formed on a surface of the display panel 6, and the touch controller 71 is mounted on the display driver 1 in On-Chip manner.

Although no special restriction is intended, the host processor 31 is configured as a base band application processor (BB/APP) which controls a communication protocol process and other application software program processes. Although no special restriction is intended, the BB/APP 31 has: DSP (Digital Signal Processor) 80 which performs signal processes which audio signals and transmit and receive signals are involved in; ASIC (Application Specific Integrated Circuits) 81 which provides a custom function (user logic); a microprocessor or microcomputer (also, abbreviated as "MICOM") 82 which serves as a data processing device operable to control the whole; and an MIPI interface circuit 83 which interfaces with the display driver 1 and the like. Although no special restriction is intended, a voice/audio interface 84 which performs the input/output of signals on a speaker 89 and a microphone 88, a communication part 85, such as a high frequency interface, which performs the signal input from an antenna 86 and the signal output thereto, and a nonvolatile file memory 87 are connected to the host processor 31 in addition to the display panel module 2A.

While the invention made by the inventor has been described above based on the embodiments concretely, the invention is not limited to the embodiments. It is obvious that various changes and modifications may be made without departing subject matter thereof.

For instance, the form of connecting an array of the external output terminals of the display driver to mounting wiring lines, the method for connecting the external output terminals of the display driver to the mounting wiring lines, the wiring structure of electrodes on a glass substrate of a display panel and the material thereof, and the wiring structure of FPC substrate and its material are not limited to the above embodiments, and they may be changed or modified appropriately. Further, the resolution of a display panel to be driven is not limited to those listed in FIG. 11 and obviously it can be another resolution. The array of the external output terminals of the display driver is not limited to the double-row layout arranged so that two rows are different from each other in pitch as shown in FIG. 2; a triple-row layout or a single-row layout may be adopted therefor.

In the case of the display driver which does not utilize the selector 72, the display driver may directly output gate drive signals to the gate electrode lines Gtd_1 to Gtd_m of the display panel. Further, the display driver may have a touch panel controller.

In addition, the order of writing unit display data into the array of the registers REG of the input-stage line latch circuit 44B, and the order of reading unit display data from the array of the registers REG of the output-stage line latch circuit 44A are not limited to the above embodiments. They may be changed or modified appropriately within a range which does not interfere with an essential display function.

What is claimed is:

1. A display driver, comprising:

a plurality of external output terminals disposed along a first direction of the display driver;

an output circuit operable to supply display drive signals to a display panel using the external output terminals; and a control circuit operable to select an array of the external output terminals from more than one kind of arrays different in layout pitch according to an output mode data setting, wherein the selected array of the external output terminals is used by the output circuit for outputting the display drive signals.

2. The display driver according to claim 1, wherein the output circuit comprises:

a line latch circuit comprising a plurality of data registers for holding pixel data; and a drive circuit operable to produce the display drive signals from the pixel data output by the line latch circuit and provide the display drive signals to the external output terminals.

3. The display driver according to claim 2, wherein the control circuit is configured to perform write address control for sequentially writing the pixel data into the line latch circuit according to the output mode data setting, and output control for outputting, in parallel, outputs of the data registers to the drive circuit.

4. The display driver according to claim 2, wherein each of the plurality of the data registers holds the pixel data of more than one pixel as one unit.

5. The display driver according to claim 4, wherein the drive circuit is configured to output, in a time-sharing manner, the display drive signals corresponding to the pixel data of more than one pixel output by the data registers.

6. The display driver according to claim 1, wherein the more than one kind of arrays that are selectable by the control circuit comprise an array of the external output terminals in which a condition of a pitch allocated for spacing between adjacent terminals of the external output terminals is changed.

7. The display driver according to claim 6, wherein the array of the external output terminals used for outputting drive signals are arrayed from both ends of the array of the external output terminals toward the center of the array of the external output terminals along the first direction of the array.

8. The display driver according to claim 1, wherein the more than one kind of arrays that are selectable by the control circuit comprise an array of the external output terminals in which a number of the external output terminals used for outputting the display drive signals is changed.

9. The display driver according to claim 1, further comprising:

a host interface circuit; and a register circuit to input control data from the host interface circuit, wherein the control circuit is operable to select the array of the external output terminals based on the control data set in the register circuit.

10. A display panel module comprising:

a display panel comprising display elements; and a display driver configured to supply display drive signals to the display panel, wherein the display driver comprises:

a plurality of external output terminals disposed along a first direction of the display driver, an output circuit operable to produce the display drive signals to supply to the display panel using the external output terminals, and a control circuit operable to select an array of the external output terminals from more than one kind of arrays different in layout pitch according to an output mode data setting, wherein the selected array of the external output terminals is used by the output circuit for outputting the display drive signals.

11. The display panel module according to claim 10, wherein the more than one kind of arrays that are selectable by the control circuit comprise an array of the external output terminals in which a condition of a pitch allocated for spacing between adjacent terminals of the external output terminals used for outputting the display drive signals is changed.

12. The display panel module according to claim 11, wherein the more than one kind of arrays that are selectable by the control circuit further comprise an array of the external output terminals in which a number of the external output terminals used for outputting the display drive signals is changed.

13. The display panel module according to claim 11, wherein the more than one kind of arrays that are selectable by the control circuit comprise an array in which the external output terminals used for outputting the display drive signals are arrayed from both ends of the array of the external output terminals toward the center of the array of the external output terminals along the first direction of the array.

14. The display panel module according to claim 11, wherein the display driver is mounted on a glass substrate of the display panel.

15. The display panel module according to claim 11, wherein the display driver is mounted on a flexible wiring board connected to the display panel.

16. The display panel module according to claim 11, wherein the output circuit of the display driver comprises:

a line latch circuit comprising a plurality of data registers for holding pixel data; and a drive circuit operable to produce display drive signals from the pixel data output by the line latch circuit and provide the display drive signals to the external output terminals, and wherein the control circuit of the display driver is configured to perform write address control for sequentially writing the pixel data into the line latch circuit according to the output mode data setting and output control for outputting in parallel outputs of the data registers to the drive circuit.

17. The display panel module according to claim 16, wherein each of the plurality of the data registers holds pixel data of more than one pixel as one unit, and the drive circuit is configured to output, in a time-sharing manner, the display drive signals corresponding to the pixel data of more than one pixel output by the data registers, and wherein the display panel comprises select circuits configured to receive the display drive signals output by the drive circuit in the time-sharing manner, select signal lines of the display elements of the display panel corresponding to the received display drive signals, and supply the display drive signals to the selected signal lines.

18. A method, comprising:

providing a display driver comprising external output terminals disposed along a first direction;

selecting, based on output mode data setting, an array of the external output terminals from more than one kind of array different in layout pitch; and transmitting, using the selected array of the external output terminals, display driver signals to a display panel.

19. The method of claim 18, further comprising:

producing the display drive signals based on pixel data outputted by a line latch circuit in the display driver.

20. The method of claim 19, further comprising:

performing write address control for sequentially writing the pixel data into the line latch circuit according to the output mode data setting; and performing output control for outputting, in parallel, outputs of data registers in the line latch circuit that hold the pixel data to the drive circuit.

* * * * *